US010989201B2

(12) United States Patent
Yamashita et al.

(10) Patent No.: US 10,989,201 B2
(45) Date of Patent: Apr. 27, 2021

(54) CENTRIFUGAL COMPRESSOR

(71) Applicant: MITSUBISHI HEAVY INDUSTRIES COMPRESSOR CORPORATION, Tokyo (JP)

(72) Inventors: Shuichi Yamashita, Tokyo (JP); Akihiro Nakaniwa, Tokyo (JP); Ryosuke Saito, Tokyo (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 254 days.

(21) Appl. No.: 16/088,352

(22) PCT Filed: Mar. 23, 2017

(86) PCT No.: PCT/JP2017/011661
§ 371 (c)(1),
(2) Date: Sep. 25, 2018

(87) PCT Pub. No.: WO2017/170105
PCT Pub. Date: Oct. 5, 2017

(65) Prior Publication Data

US 2020/0300251 A1 Sep. 24, 2020

(30) Foreign Application Priority Data

Mar. 29, 2016 (JP) ..... JP2016-064875

(51) Int. Cl.
*F04D 17/12* (2006.01)
*F04D 29/44* (2006.01)
(Continued)

(52) U.S. Cl.
CPC ..... *F04D 17/122* (2013.01); *F04D 29/444* (2013.01); *F04D 29/284* (2013.01);
(Continued)

(58) Field of Classification Search
CPC .. F04D 177/122; F04D 29/444; F04D 29/284; F04D 29/4213; F05D 2250/314; F05D 2250/51
See application file for complete search history.

(56) References Cited

U.S. PATENT DOCUMENTS 4,695,224 A * 9/1987 Lown ..... F04D 29/5846 415/116
4,725,196 A * 2/1988 Kaneki ..... F04D 29/104 415/100
(Continued)

FOREIGN PATENT DOCUMENTS

JP H04-134700 U 12/1992
JP H09-079192 A 3/1997
(Continued)

OTHER PUBLICATIONS

International Search Report for corresponding International Application No. PCT/JP2017/011661, dated May 30, 2017 (2 pages).
(Continued)

*Primary Examiner* — Justin D Seabe
*Assistant Examiner* — Theodore C Ribadeneyra
(74) *Attorney, Agent, or Firm* — Osha Bergman Watanabe & Burton LLP

(57) ABSTRACT

A centrifugal compressor includes: a rotating shaft; a first impeller; a second impeller which is disposed on a downstream side of the first impeller; a return flow path which guides a first fluid flowing to a radially outer side from the first impeller toward a radially inner side; an introduction flow path which introduces the fluid guided to the radially inner side to the second impeller; an intermediate suction flow path which additionally supplies a second fluid to the second impeller; and a curved flow path which is connected to a downstream side of the introduction flow path and the intermediate suction flow path, and guides the first fluid and
(Continued)

the second fluid to the second impeller, wherein a side surface on an upstream side of the introduction flow path is disposed on the downstream side from a return position of the return flow path.

2 Claims, 2 Drawing Sheets

(51) Int. Cl.
*F04D 29/28* (2006.01)
*F04D 29/42* (2006.01)

(52) U.S. Cl.
CPC .... *F04D 29/4213* (2013.01); *F05D 2250/314* (2013.01); *F05D 2250/51* (2013.01)

(56) References Cited

U.S. PATENT DOCUMENTS

2006/0198727 A1 9/2006 Arnold et al.
2007/0140889 A1 6/2007 Chen et al.
2010/0232984 A1* 9/2010 Bade ..... F04D 29/584 417/53
2011/0311356 A1* 12/2011 Masutani ..... F04D 29/4213 415/203
2013/0259644 A1* 10/2013 Kobayashi ..... F04D 17/122 415/68
2014/0133959 A1 5/2014 Iurisci et al.
2015/0345507 A1 12/2015 Koga et al.
2015/0354588 A1* 12/2015 Yamashita ..... F04D 29/284 415/204
2016/0327056 A1 11/2016 Nakaniwa et al.

FOREIGN PATENT DOCUMENTS

JP H09-144698 A 6/1997
WO 2015/119189 A1 8/2015

OTHER PUBLICATIONS

Written Opinion for corresponding International Application No. PCT/JP2017/011661, dated May 30, 2017 (7 pages).

* cited by examiner

CENTRIFUGAL COMPRESSOR

TECHNICAL FIELD

The present invention relates to a centrifugal compressor.

Priority is claimed on Japanese Patent Application No. 2016-64875, filed Mar. 29, 2016, the content of which is incorporated herein by reference.

BACKGROUND OF THE INVENTION

A multistage centrifugal compressor which compresses gas using a plurality of impellers provided on a rotating shaft extending in an axial direction is known as one type of centrifugal rotary machine (see, for example, Patent Document 1). In this multistage centrifugal compressor, the gas is introduced to the impeller constituting each compression stage via an introduction flow path extending from a radially outer side to a radially inner side and a curved flow path connected to an end of the introduction flow path on the radially inner side and bent and extending toward a downstream side.

Also, when the multistage centrifugal compressor is used in a refrigerator, intermediate suction is carried out due to restrictions on operating conditions of the refrigerator. The intermediate suction is a method in which a gas introduced from the outside of a system of the refrigerator into a gas inlet is flown into the impeller of second and subsequent compression stages.

DOCUMENTS OF RELATED ART

Patent Documents

Patent Document 1: PCT International Publication No. WO2015/119189

SUMMARY OF THE INVENTION

Problems to be Solved by the Invention

However, the width of the introduction flow path in an axial direction (axial direction of the rotating shaft) (the distance between an upstream side surface and a downstream side surface of the introduction flow path, and a blade height of a return vane provided in the introduction flow path) is determined to match the suction shape of the impeller connected to the downstream side. When the impeller on the downstream side is an impeller with a large flow coefficient, it is necessary to increase the width in the axial direction.

In this case, a flow path cross-sectional area of the introduction flow path is greatly enlarged toward the radially inner side, but there is a problem that the flow velocity of the gas decreases in the introduction flow path and separation is likely to occur.

Further, when the side surface of the introduction flow path on the upstream side in the axial direction is inclined upstream toward the radially inner side to shorten the length of the centrifugal compressor in the axial direction, separation is more likely to occur. In particular, when the intermediate suction is performed, since the length of the centrifugal compressor in the axial direction becomes long, it is necessary to make the inclination larger, and separation of the gas on the downstream side of the introduction flow path tends to be promoted.

It is an object of the present invention to provide a centrifugal compressor having an intermediate suction flow path, capable of minimizing separation of gas in an introduction flow path which guides the gas toward a radially inner side.

Means to Solve the Problems

According to a first aspect of the present invention, a centrifugal compressor includes: a rotating shaft which extends in an axial direction; an impeller which is provided on the rotating shaft; a second impeller which is provided on the rotating shaft and disposed on a downstream side of the first impeller; a return flow path which guides a first fluid flowing to a radially outer side from the first impeller toward a radially inner side; an introduction flow path which introduces the fluid guided to the radially inner side by the return flow path to the second impeller; an intermediate suction flow path which is adjacent to the introduction flow path and additionally supplies a second fluid to the second impeller; and a curved flow path which is connected to a downstream side of the introduction flow path and the intermediate suction flow path, extends to be bent toward the downstream side in the axial direction and guides the first fluid and the second fluid to the second impeller, wherein a side surface on an upstream side of the introduction flow path is disposed on the downstream side from a return position of the return flow path in the axial direction.

According to such a constitution, in the centrifugal compressor in which the second fluid is introduced to the second impeller via the intermediate suction flow path, separation of the first fluid which has passed through the return flow path on the downstream side of the first impeller and guided to the introduction flow path can be minimized Therefore, it is possible to improve the efficiency of the centrifugal compressor.

In the centrifugal compressor, when an angle formed between a side surface on the upstream side of the introduction flow path and a surface orthogonal to an axis is $\theta$, the side surface on the upstream side of the introduction flow path may be formed to satisfy $0° \leq \theta \leq 15°$.

According to such a constitution, an inclination angle of the side surface on the upstream side of the introduction flow path is defined, and the separation can be reliably minimized.

Effects of the Invention

According to the present invention, in a centrifugal compressor in which a second fluid is introduced to a second impeller via an intermediate suction flow path, separation of the first fluid which has passed through a return flow path on the downstream side of a first impeller and guided to an introduction flow path can be minimized Therefore, it is possible to improve efficiency of the centrifugal compressor.

EMBODIMENTS FOR CARRYING OUT THE INVENTION

Figure 1:
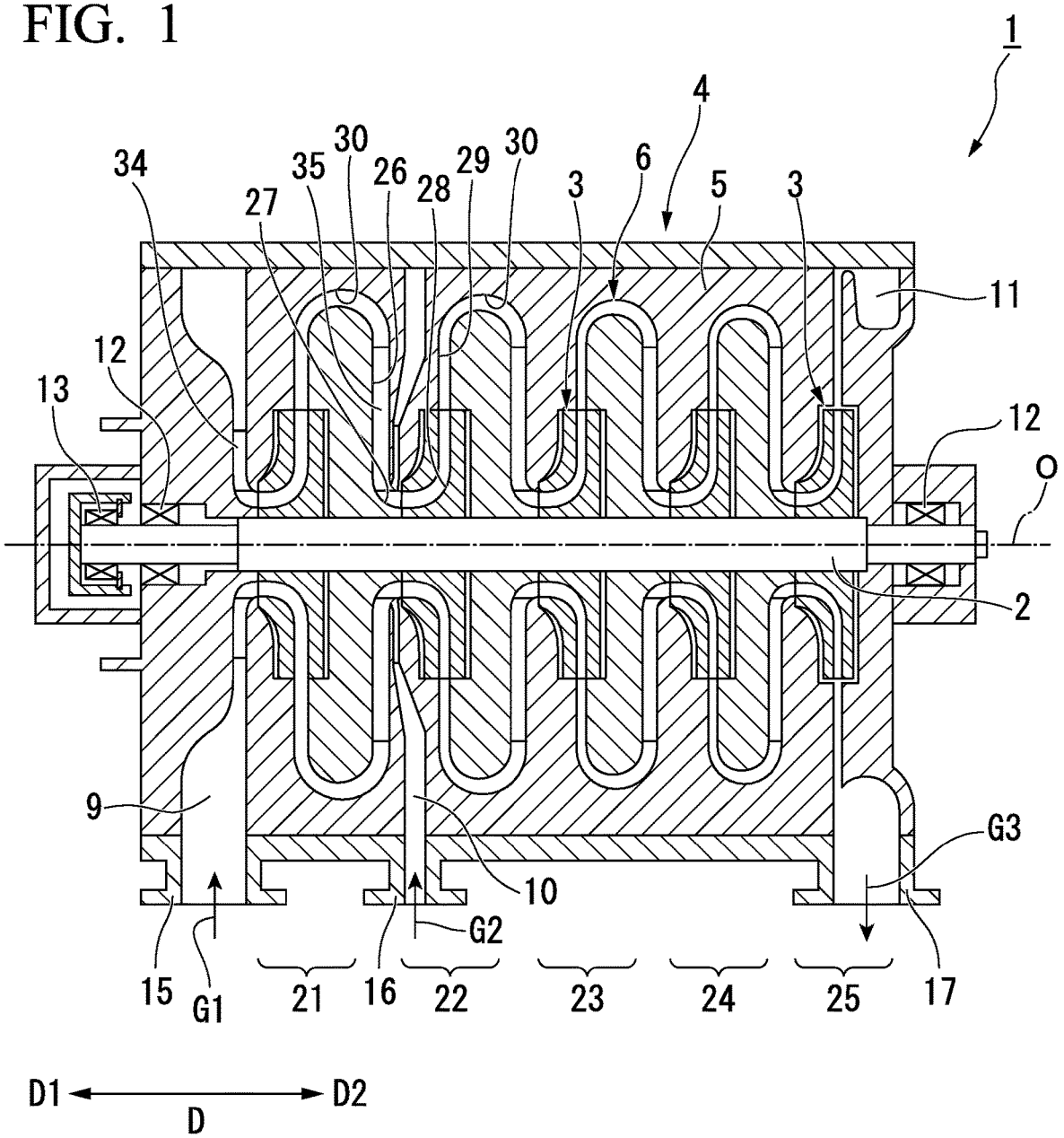
FIG. 1 is a cross-sectional view showing a constitution of a centrifugal compressor according to an embodiment of the present invention.

Hereinafter, a centrifugal compressor according to an embodiment of the present invention will be described in detail with reference to the drawings.

A centrifugal compressor of the embodiment is constituted as a so-called barrel type single-shaft multistage centrifugal compressor. The centrifugal compressor of the embodiment is driven to rotate an impeller via a rotating shaft by a driving device (not shown in the drawings), thereby applying a centrifugal force to a gas supplied to the impeller and compressing the gas.

As shown in FIG. 1, the centrifugal compressor 1 of the embodiment includes: a rotating shaft 2 which rotates around an axis O; a plurality of impellers 3 which are provided on the rotating shaft 2; a cylindrical casing 4 (cabin) which forms an outer shell of the centrifugal compressor 1; and a diaphragm 5 which is accommodated in the casing 4 and covers a circumference of the rotating shaft 2 to form a flow path 6 which connects the impellers 3. The centrifugal compressor 1 has five compression stages 21, 22, 23, 24 and 25.

The centrifugal compressor 1 further includes: a suction nozzle 15 which introduces a first gas G1 into the centrifugal compressor 1; an intermediate suction nozzle 16 which introduces a second gas G2 into an intermediate suction flow path 10; and a discharge nozzle 17 which discharges a compressed gas G3.

The casing 4 of the embodiment is a horizontal split type that is divided into two to include the axis O.

In the following description, a direction in which the axis O of the rotating shaft 2 extends is referred to as an axial direction D. Further, a direction orthogonal to the axis O is referred to as a radial direction, a side which is away from the axis O in the radial direction is referred to as a radially outer side, and a side which approaches the axis O in the radial direction is referred to as a radially inner side. In the axial direction D, a left side of FIG. 1 is referred to as an upstream side D1 and a right side of FIG. 1 is referred to as a downstream side D2.

The diaphragm 5 is divided into a plurality of parts corresponding to the respective compression stages 21, 22, 23, 24 and 25 of the centrifugal compressor 1.

A suction flow path 9 which introduces the first gas G1 into the flow path 6 via the suction nozzle 15 is formed in the vicinity of an end of the diaphragm 5 on the upstream side D1.

A discharge flow path 11 which communicates with a discharge nozzle 17 is formed in the vicinity of an end of the diaphragm 5 on the downstream side D2.

The rotating shaft 2 extends to pass through the inside of the casing 4 along the axis O. A journal bearing 12 and a thrust bearing 13 are provided at both ends of the casing 4 in the axial direction D, respectively. The rotating shaft 2 is supported to be rotatable around the axis O by the journal bearing 12 and the thrust bearing 13.

Figure 2:
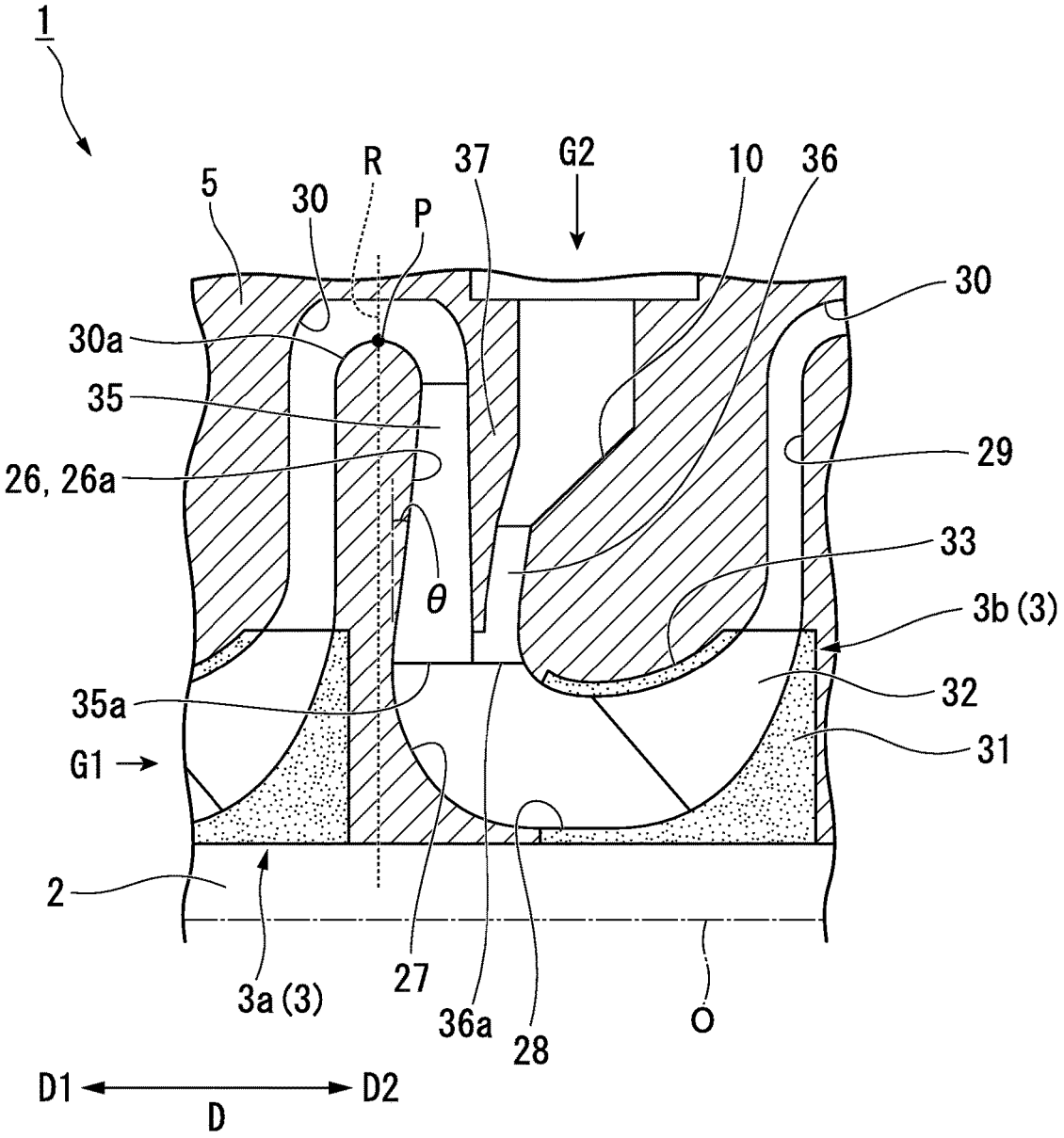
FIG. 2 is a cross-sectional view showing an intermediate suction flow path of the centrifugal compressor according to the embodiment of the present invention.

The centrifugal compressor 1 of the embodiment includes a first compression stage 21, a second compression stage 22, a third compression stage 23, a fourth compression stage 24 and a fifth compression stage 25 in order from the upstream side D1 toward the downstream side D2. As shown in FIG. 2, each of the compression stages includes: an introduction flow path 26; a curved flow path 27; a compression flow path 28 (impeller 3); a diffuser flow path 29; and a return flow path 30 (return bend). The introduction flow path 26 is a flow path that guides the gas G from the radially outer side of the axis O toward the radially inner side thereof. The curved flow path 27 is a flow path which is connected to the radially inner side of the introduction flow path 26 on the downstream side, extends to be curved from a position connected to the introduction flow path 26 toward the downstream side D2 and supplies the gas G to the impeller 3. The compression flow path 28 is a flow path that compresses the gas G The diffuser flow path 29 is a flow path that guides the compressed gas G from the radially inner side toward the radially outer side. The return flow path 30 is a flow path which guides the gas G flowing to the radially outer side toward the radially inner side.

The impeller 3 includes: a disk 31 having a substantially circular cross section when seen in the axial direction D; a plurality of blades 32 provided on a surface of the disk 31 on the upstream side D1; and a shroud 33 which covers the plurality of blades 32 from the upstream side D1.

Each of the impellers 3 may be an open impeller without the shroud.

In the first compression stage 21, the radially outer side which is the upstream side of the introduction flow path 26 is connected to the suction flow path 9.

The introduction flow path 26 in the second and subsequent compression stages 22, 23, 24 and 25 communicates with a downstream end of the return flow path 30 in the former stage. That is, a flowing direction of the gas G which has passed through the return flow path 30 is changed so that the gas G is guided to the radially inner side and then directed toward the downstream side D2 along the axis O.

The introduction flow path 26 is a flow path which guides the gas G directed toward the radially inner side via the return flow path 30 to the impeller 3. An end of the introduction flow path 26 on radially outer side communicates with the return flow path 30. An end of the introduction flow path 26 on radially inner side communicates with the impeller 3 (compression flow path 28) via the curved flow path 27.

A plurality of return vanes 35 are provided in the introduction flow path 26. The plurality of return vanes 35 are radially disposed around the axis O in the introduction flow path 26. The return vanes 35 straighten the gas G into a flow that is directed to the radially inner side.

An inlet guide vane 34 (refer to FIG. 1) capable of changing an inclination of the vanes by a mechanism which is not shown in the drawings is provided on the upstream side of the first compression stage 21.

The curved flow path 27 is a flow path which is connected to the radial inner side of the introduction flow path 26 on the downstream side, extends to be curved from the position connected to the introduction flow path 26 toward the downstream side D2. Therefore, a flow of the gas G directed toward the radially inner side changes to a flow toward the downstream side D2. The gas G flowing to the downstream side D2 is guided to the impeller 3 and compressed.

The compression flow path 28 is a flow path surrounded by a surface of the impeller 3 on the upstream side D1 of the disk 31, a surface on the downstream side D2 of the shroud 33 and a pair of blades 32 adjacent in a circumferential direction. The cross-sectional area of the compression flow path 28 gradually decreases from the radially inner side toward the radially outer side. Therefore, the gas G flowing through the compression flow path 28 in a state in which the impeller 3 is rotating is gradually compressed to a high pressure.

The diffuser flow path 29 is a flow path that extends from the radially inner side toward the outside. An end of the diffuser flow path 29 on radially inner side communicates with an end of the compression flow path 28 on the radially outer side.

The return flow path 30 reverses the flowing direction of the gas G flowing from the radially inner side toward the radially outer side through the diffuser flow path 29. One end side (upstream side D1) of the return flow path 30 communicates with the diffuser flow path 29, and the other end side (downstream side D2) communicates with the introduction flow path 26.

An end of the diffuser flow path 29 of the fifth compression stage 25 on the radially outer side is connected to the discharge nozzle 17.

The intermediate suction flow path 10 which additionally supplies the second gas G2 to a second impeller 3*b* of the second compression stage 22 is connected to the flow path 6 between the first compression stage 21 and the second compression stage 22. The intermediate suction flow path 10 is connected to the radially inner side (the upstream side of the second impeller 3*b* in the second compression stage 22) which is the downstream side of the introduction flow path 26 of the second compression stage 22. A plurality of straightening vanes 36 which straighten the second gas G2 flowing through the intermediate suction flow path 10 are provided on the radially inner side of the intermediate suction flow path 10.

The intermediate suction flow path 10 is formed so that the radially outer side thereof which is the upstream side is connected to the intermediate suction nozzle 16 (refer to FIG. 1) and the radially inner side thereof which is the downstream side is connected to the curved flow path 27 of the second compression stage 22. The intermediate suction flow path 10 is formed adjacent to the introduction flow path 26. The intermediate suction flow path 10 and the introduction flow path 26 are partitioned by a partition wall 37.

The partition wall 37 matches the flowing direction of the gas G flowing into the two flow paths by partitioning the introduction flow path 26 and the intermediate suction flow path 10 in the axial direction D.

The plurality of straightening vanes 36 are provided in the intermediate suction flow path 10 to straighten the second gas G2 suctioned from the intermediate suction nozzle 16 into a flow toward the radially inner side. A position of a radially inner end 36*a* on the downstream side of the straightening vane 36 in the radial direction is the same as a position of a radially inner end 35*a* on the downstream side of the return vane 35 in the radial direction.

A side surface 26*a* on the upstream side of the introduction flow path 26 of the second compression stage 22 of the embodiment is formed on the downstream side D2 from a return position R of the return flow path 30 of the first compression stage 21 connected to the radially outer side of the introduction flow path 26 in the axial direction D. In other words, the side surface 26*a* on the upstream side of the introduction flow channel 26 in the second compression stage 22 is formed on the downstream side D2 from an apex portion P (the radially outermost apex portion) of a circumferential surface 30*a* on the inner circumferential side of the return flow path 30 of the first compression stage 21 in the radial direction.

Therefore, a curve in the axial direction D of the flow path 6 which connects the first impeller 3*a* of the first compression stage 21 with the second impeller 3*b* of the second compression stage 22 is reduced.

The side surface 26*a* on the upstream side of the introduction flow path 26 is a surface which faces the downstream side D2 in the diaphragm 5 forming the introduction flow path 26.

Further, when an angle formed between the side surface 26*a* on the upstream side of the introduction flow path 26 and a surface orthogonal to the axis O in the embodiment is θ, the side surface 26*a* on the upstream side of the introduction flow path 26 is formed to satisfy $0° \leq \theta \leq 15°$.

Next, an operation of the centrifugal compressor 1 of the embodiment will be described.

In the centrifugal compressor 1 in a normal operating state, the gas G behaves as follows.

First, the first gas G1 introduced into the flow path 6 from the suction nozzle 15 flows into the compression flow path 28 of the first impeller 3*a* via the introduction flow path 26 of the first compression stage 21. Since the impeller 3 rotates around the axis O with rotation of the rotating shaft 2, a centrifugal force directed radially outward from the axis O is added to the first gas G1 in the compression flow path 28. In addition, since the cross-sectional area of the compression flow path 28 gradually decreases from the radially outer side to the inner side, the first gas G1 is gradually compressed. Accordingly, the high-pressure gas G is delivered from the compression flow path 28 to the subsequent diffuser flow path 29.

The high-pressure gas G flowing out from the compression flow path 28 sequentially passes through the diffuser flow path 29, the return flow path 30, the introduction flow path 26 and the curved flow path 27 in order. Thereafter, the same compression is also applied to the impeller 3 of the second compression stage 22. Further, the second gas G2 is added to the second impeller 3*b* of the second compression stage 22 via the intermediate suction nozzle 16 and the intermediate suction flow path 10. Eventually, the gas G reaches a desired pressure state and is supplied from the discharge nozzle 17 to an external device (not shown in the drawings).

According to the above-described embodiment, in the centrifugal compressor 1 in which the second gas G2 is introduced into the radially inner side on the downstream side of the introduction flow path 26 of the second compression stage 22 via the intermediate suction flow path 10, separation of the first gas G1 which has passed through the return flow path 30 of the first compression stage 21 and been guided to the introduction flow path 26 of the second compression stage 22 is minimized.

That is, since the side surface 26*a* on the upstream side of the introduction flow path 26 of the second compression stage 22 is formed on the downstream side D2 from the return position R of the return flow path 30 of the first compression stage 21 connected to the radially outer side of the introduction flow path 26 in the axial direction D, the inclination toward the upstream side D1 of the side surface 26*a* decreases, and separation of the first gas G1 from the side surface 26*a* on the upstream side of the introduction flow path 26 is minimized.

Therefore, it is possible to improve the efficiency of the centrifugal compressor. In particular, since turbulence of the flow is caused by the second gas G2 when the second gas G2 is introduced into the curved flow path 27 of the second compression stage 22 via the intermediate suction flow path 10, the minimizing of the separation at the upstream side of the curved flow path 27 is important.

Although embodiments of the present invention have been described in detail, various modifications can be made without departing from the technical idea of the present invention.

For example, although the intermediate suction flow path 10 of the above-described embodiment is formed between the first compression stage 21 and the second compression stage 22, it is not limited thereto. For example, the intermediate suction flow path 10 may be formed between the second compression stage 22 and the third compression stage 23.

INDUSTRIAL APPLICABILITY

According to the present invention, in the centrifugal compressor in which a second fluid is introduced into the second impeller via the intermediate suction flow path, the separation of the first fluid which has passed through the return flow path on the downstream side of the first impeller and been guided to the introduction flow path can be minimized Therefore, it is possible to improve the efficiency of the centrifugal compressor.

DESCRIPTION OF REFERENCE NUMERALS

1 Centrifugal compressor
2 Rotating shaft
3 Impeller
4 Casing
5 Diaphragm
6 Flow path
9 Suction flow path
10 Intermediate suction flow path
11 Discharge nozzle
15 Suction nozzle
16 Intermediate suction nozzle
17 Discharge nozzle
21 First compression stage
22 Second compression stage
23 Third compression stage
24 Fourth compression stage
25 Fifth compression stage
26 Introduction flow path
26*a* Side surface
27 Curved flow path
28 Compression flow path
29 Diffuser flow path
30 Return flow path
34 Inlet guide vane
35 Return vane
36 Straightening vane
37 Partition wall
D Axial direction
D1 Upstream side
D2 Downstream side
G Gas
G1 First gas (first fluid)
G2 Second gas (second fluid)
O Axis
R Return position

The invention claimed is:

1. A centrifugal compressor comprising:

a rotating shaft which extends in an axial direction;

a first impeller which is provided on the rotating shaft;

a second impeller which is provided on the rotating shaft and disposed on a downstream side of the first impeller;

a return flow path which guides a first fluid flowing to a radially outer side from the first impeller toward a radially inner side;

an introduction flow path which introduces the first fluid guided to the radially inner side by the return flow path to the second impeller;

a plurality of return vanes provided in the introduction flow path;

an intermediate suction flow path which is adjacent to the introduction flow path and additionally supplies a second fluid to the second impeller;

a plurality of straightening vanes provided on a radially inner side of the intermediate suction flow path; and a curved flow path which is connected to a downstream side of the introduction flow path and the intermediate suction flow path, extends to be bent toward the downstream side in the axial direction, and guides the first fluid and the second fluid to the second impeller, wherein a side surface on an upstream side of the introduction flow path is disposed on the downstream side from a return position of the return flow path in the axial direction, and wherein a position of a radially inner end of the downstream side of the straightening vane in the radial direction is the same as a position of a radially inner end on the downstream side of the return vane in the radial direction at an end of an upstream side of the curved flow path.

2. The centrifugal compressor according to claim 1, wherein, when an angle formed between the side surface on the upstream side of the introduction flow path and a surface orthogonal to an axis is $\theta$, the side surface on the upstream side of the introduction flow path is formed to satisfy $0° \leq \theta \leq 15°$.

* * * * *